US005542395A

United States Patent [19]

Tuckey et al.

[11] Patent Number: 5,542,395

[45] Date of Patent: Aug. 6, 1996

[54] TEMPERATURE-COMPENSATED ENGINE FUEL DELIVERY

[75] Inventors: Charles H. Tuckey, Cass City; Kirk D. Doane, Bay City, both of Mich.

[73] Assignee: Walbro Corporation, Cass City, Mich.

[21] Appl. No.: 151,992

[22] Filed: Nov. 15, 1993

[51] Int. Cl.[6] ..... F02M 37/04

[52] U.S. Cl. ..... 123/497; 123/381

[58] Field of Search ..... 123/497, 456, 123/381, 514

[56] References Cited

U.S. PATENT DOCUMENTS

| | | | |
|---|---|---|---|
| 3,817,225 | 6/1974 | Priegel | 123/497 |
| 3,935,851 | 2/1976 | Wright | 123/497 |
| 4,048,964 | 9/1977 | Kissel | 123/497 |
| 4,174,694 | 11/1979 | Wessel | 123/581 |
| 4,260,333 | 4/1981 | Schillinger | 123/497 |
| 4,728,264 | 3/1988 | Tuckey . | |
| 4,756,291 | 7/1988 | Cummins et al. . | |
| 4,774,923 | 10/1988 | Hayashi | 123/381 |
| 4,789,308 | 12/1988 | Tuckey . | |
| 4,791,904 | 12/1988 | Grieshaber | 123/381 |
| 4,800,859 | 1/1989 | Sagisaka et al. . | |
| 4,919,102 | 4/1990 | Iwabuchi . | |
| 4,920,946 | 5/1990 | Fujimori et al. . | |
| 4,951,636 | 8/1990 | Tuckey . | |
| 5,001,934 | 3/1991 | Tuckey . | |
| 5,044,344 | 9/1991 | Tuckey et al. . | |
| 5,120,201 | 6/1992 | Tuckey et al. . | |
| 5,122,039 | 6/1992 | Tuckey . | |
| 5,133,323 | 7/1992 | Treusch | 123/497 |
| 5,148,792 | 9/1992 | Tuckey . | |
| 5,237,975 | 8/1993 | Betki | 123/497 |
| 5,337,918 | 8/1994 | Tuckey | 123/497 |
| 5,379,741 | 1/1995 | Matysiewicz | 123/497 |

*Primary Examiner*—Carl S. Miller

*Attorney, Agent, or Firm*—Barnes, Kisselle, Raisch, Choate, Whittemore & Hulbert

[57] ABSTRACT

A fuel delivery system for an internal combustion engine that includes a fuel pump responsive to application of electrical power for delivering fuel under pressure to the engine. A pressure sensor supplies a pressure signal as a function of fuel pump output pressure. Electrical circuitry is responsive to the pressure signal for applying electrical power to the pump. A temperature sensor is operatively coupled to the circuitry for automatically varying the pump power signal to increase fuel pump output pressure when temperature at the temperature sensor exceeds preselected threshold temperature.

12 Claims, 2 Drawing Sheets

TEMPERATURE-COMPENSATED ENGINE FUEL DELIVERY

The present invention is directed to fuel delivery systems for internal combustion engines, and more particularly to a system and method for improving engine performance at high engine/fuel temperatures.

BACKGROUND AND OBJECTS OF THE INVENTION

It has heretofore been proposed to supply fuel to an internal combustion engine by means of a pressure-controlled electric-motor fuel pump and a one-way or non-return fuel line that connects the pump to fuel injectors at the engine. For example, U.S. Pat. No. 4,951,636 discloses a fuel delivery system for internal combustion engines in which an electric-motor fuel pump supplies fuel under pressure to one or more fuel injectors carried by the engine. An engine air intake manifold is carried by the engine and supplied with combustion air. A pressure sensor is responsive to a pressure differential between the fuel injector and the air intake manifold for controlling a pulse width modulated drive signal applied to the fuel pump so as to maintain substantially constant pressure differential between the fuel and combustion air across the injector. U.S. Pat. Nos. 5,001,934, 5,044,344 and 5,148,792 disclose other internal combustion engine fuel delivery systems in which fuel delivery is responsive to fuel pressure.

Among the many design criteria for internal combustion engine fuel delivery systems is the ability to provide sufficient fuel at high engine/fuel temperature conditions for starting and operation of the engine. A typical "hot soak" test for fuel delivery systems is to operate an automobile at high ambient temperature until the engine is hot, and then terminate operation of the engine, and therefore the engine cooling system, while maintaining high ambient temperature so that the engine temperature and temperature under the automobile hood increase significantly. Under these conditions, fuel within the engine fuel rail may vaporize. When it is then attempted to operate the automobile, the engine may fail to start, or if started may fail to idle or run smoothly. It is a general object of the present invention to provide a fuel delivery system and method for internal combustion engines that yield satisfactory performance under normal operating conditions and provide improved performance at high engine/fuel temperature conditions as compared with the prior art, and that are economical to manufacture and implement in a mass production environment. It is a more specific object of the present invention to provide a fuel delivery system and method of the described character that improve hot restart, idling and drive-away performance.

SUMMARY OF THE INVENTION

Fuel pressure is controlled at an internal combustion engine in accordance with a presently preferred embodiment of the invention by sensing fuel temperature both above and below a preselected temperature threshold. Below the temperature threshold, a preselected substantially constant fuel pressure characteristic is maintained at the engine, such as a substantially constant pressure differential across the fuel injector(s) as taught by the patent noted above. Above the temperature threshold, fuel pressure at the engine is automatically increased over and above the preselected temperature characteristic. Such pressure increase preferably is a preselected function of temperature, either a step-function pressure increase at the preselected temperature threshold, or a gradual (e.g., linear) pressure-increase as a function of temperature between the preselected temperature threshold and a second higher temperature threshold. In this way, fuel pressure is automatically increased at the engine under high engine/fuel temperature conditions, improving hot-restart of the engine, and reducing rough idle and drive-away stumble under extremely hot conditions.

A fuel delivery system for an internal combustion engine in accordance with the preferred embodiments of the invention includes a fuel pump responsive to application of electrical power for delivering fuel under pressure to the engine. A pressure sensor supplies a pressure signal as a function of fuel pump output pressure. Electrical circuitry is responsive to the pressure signal for applying electrical power to the pump. A temperature sensor is operatively coupled to the circuitry for automatically varying the pump power signal to increase fuel pump output pressure when temperature at the temperature sensor exceeds the preselected threshold temperature. The temperature sensor preferably is responsive to fuel temperature, but alternatively may be responsive to ambient under-hood temperature around the engine. The temperature sensor may be integral with the pressure sensor for automatically modifying the pressure signal above the preselected temperature threshold. Alternatively, the temperature sensor may comprise a separate sensor element that provides an electrical temperature signal employed by the pump power control circuitry for modifying the pressure sensor signal, which is the primary pump control signal of the delivery system.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
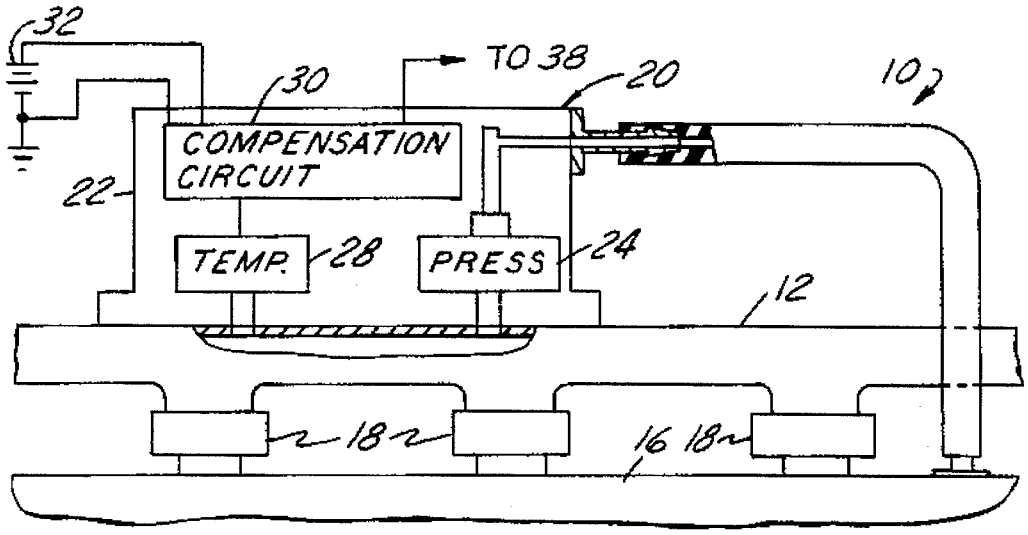
FIG. 1 is a fragmentary schematic drawing of an engine fuel delivery system in accordance with a presently preferred embodiment of the invention.

FIG. 1 illustrates a fuel delivery system 10 in accordance with the present invention as comprising a fuel rail 12 that receives fuel under pressure from an electric-motor fuel pump 14 (FIG. 2), and a combustion air intake manifold 16 that receives combustion air at atmospheric pressure through an intake filter (not shown) or at elevated pressure from a turbocharger (also not shown). One or more fuel injectors 18 are disposed between fuel rail 12 and air manifold 16, and are responsive to electrical signals from an engine control unit or the like for delivering fuel under pressure from rail 12 into manifold 16 adjacent to the intake ports of associated cylinders. A control unit 20 is mounted on fuel rail 12 within an enclosure 22. Unit 20 includes a pressure sensor 24 having a first input responsive to pressure of fuel within rail 12, and a second or reference input connected to air manifold 16 by a conduit 26 so as to be responsive to air pressure within manifold 16. A temperature sensor 28 is disposed within enclosure 22, and is responsive to temperature of fuel within rail 12. Pressure sensor 24 and temperature sensor 28 provide corresponding electrical signals to a compensation circuit 30, which receives electrical power from the automobile electrical system represented by a battery 32, and supplies a control signal to the pump drive circuitry (FIG. 2) for applying electrical power to pump 14.

Figure 2:
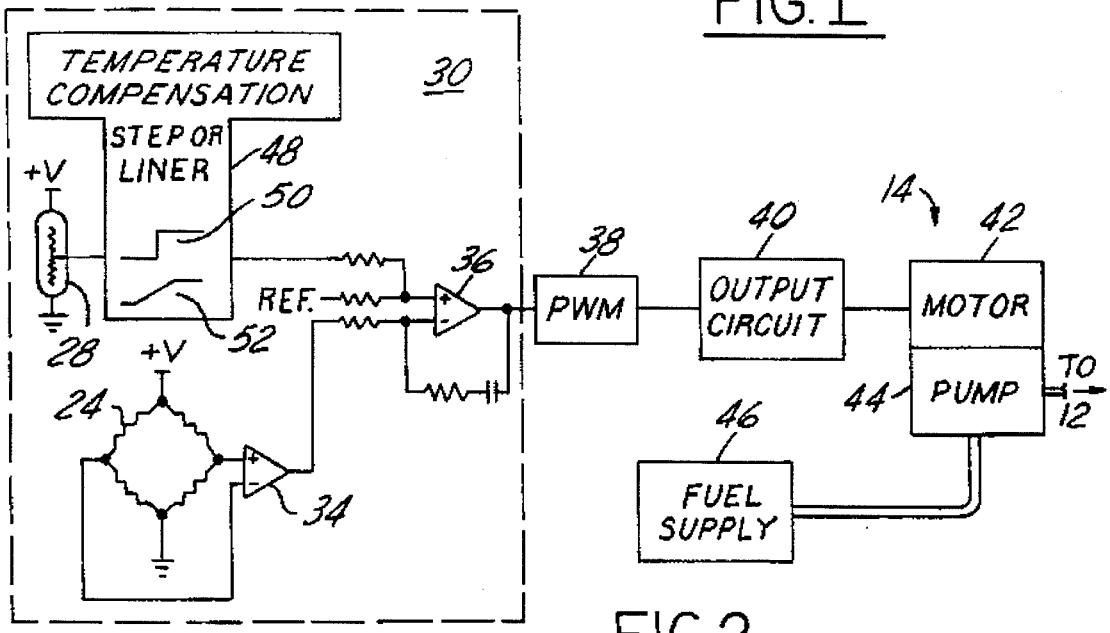
FIG. 2 is a functional block diagram of the fuel delivery system fragmentarily illustrated in FIG. 1.

Referring to FIG. 2, pressure sensor 24 preferably comprises a piezoelectric strain gauge sensor of the type disclosed in above-noted U.S. Pat. No. 5,001,934, which provides an electrical signal to an amplifier 34 within compensation circuit 30 as a direct function of fuel pressure within rail 12. The output of amplifier 34 is fed to the inverting input of an amplifier 36, which has its non-inverting input connected to receive a reference voltage indicative of desired pump outlet fuel pressure under normal operating conditions. The output of amplifier 36 is fed to a pulse width modulation amplifier 38, which provides a control signal to an output power circuit 40. The output of power circuit 40 alternately switches between high and low digital levels at a frequency and/or duty cycle, preferably at fixed and variable duty cycle, that varies as a function of desired pump output pressure. Output power circuit 40 preferably comprises an FET switch that alternately connects and disconnects vehicle power source 32 (FIG. 1) to the motor 42 of motor/pump 14. Motor 42 drives the pump 44 of motor/pump 14 for supplying fuel under pressure to fuel rail 12 (FIG. 1) from a fuel supply or tank 46. Combined motor/pump 14 may be of the type disclosed in U.S. Pat. Nos. 5,122,039 and 5,148,792.

Temperature sensor 28, which may comprise a thermistor or other suitable temperature sensor, is connected to a temperature compensation circuit 48 within compensation circuit 30. Temperature compensation circuit 48 compares the input signal from temperature sensor 28 with a preselected temperature threshold—i.e., preselected as a function of engine design parameters and/or desired operating characteristics—and provides a temperature compensation signal to the non-inverting input of amplifier 36 as a preselected function of temperature above the temperature threshold. Such preselected function may comprise a step function 50, whereby a preselected voltage is added to the reference voltage at the non-inverting input of amplifier 36 above the temperature threshold of temperature compensation circuit 48, automatically effectively to increase the pressure reference level, and thereby automatically to increase the effective level of the electrical power signal applied to pump 14 and increase pump output pressure. Preferably, the stepped pressure increase of pump outlet pressure is on the order of about 15 to 20 percent, such as an increase of 10 psi over a nominal fuel pressure of 55 psi when fuel temperature reaches a threshold level of 200° F. Alternatively, temperature compensation circuit 48 may apply a compensation signal to the non-inverting input of amplifier 36 that increases linearly 52 between lower and upper temperature thresholds, thereby automatically linearly increasing pump outlet pressure as temperature varies between such thresholds. For example, pump outlet pressure may automatically be increased 10 psi over and above the nominal operating pressure of 55 psi as fuel temperature varies between a lower threshold of 100° F. and a upper threshold of 250° F. In either event, fuel pressure is automatically increased at the engine as a function of engine/fuel temperature so as to improve starting, idle and drive-away characteristics of the engine under high temperature conditions.

Figure 3:
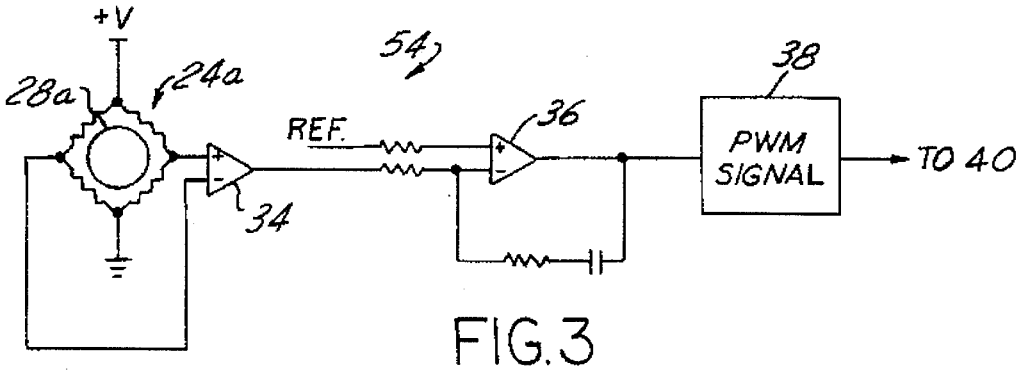
FIGS. 3 and 4 are functional block diagrams of respective modifications to the embodiment of FIG. 2.

FIG. 3 illustrates a modification to FIG. 2 in which the temperature sensor **28*a* is incorporated in the pressure sensor 24*a*. Below the preselected threshold pressure, pressure sensor 24*a* operates in the same manner as pressure sensor 24 in FIG. 2, providing a signal to amplifier 36 for comparison to the preselected reference level to drive PWM amplifier 38 and the pump motor. Above the temperature threshold setting of sensor 28*a*, sensor 28*a* alters the operating characteristics of pressure sensor 24*a*** so as to vary the pressure sensor output signal automatically, as a step or linear function of temperature as described above, as a combined function of temperature and pressure.

Figure 4:
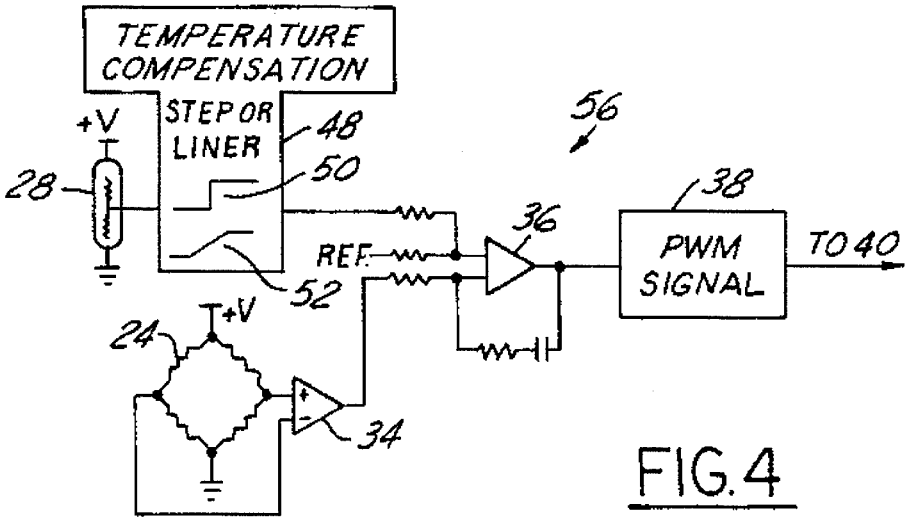

FIG. 4 illustrates another modification 56 to the embodiment of FIGS. 1 and 2 in which pressure sensor 24 is disposed at the fuel pump as disclosed in above-noted U.S. Pat. Nos. 5,044,344 and 5,148,792. Temperature sensor 28 is disposed so as to be responsive to engine temperature or ambient under-hood temperature surrounding the engine. Otherwise, operation of the embodiment in FIG. 4 is identical to that hereinabove described in connection with FIGS. 1 and 2.

Figure 5:
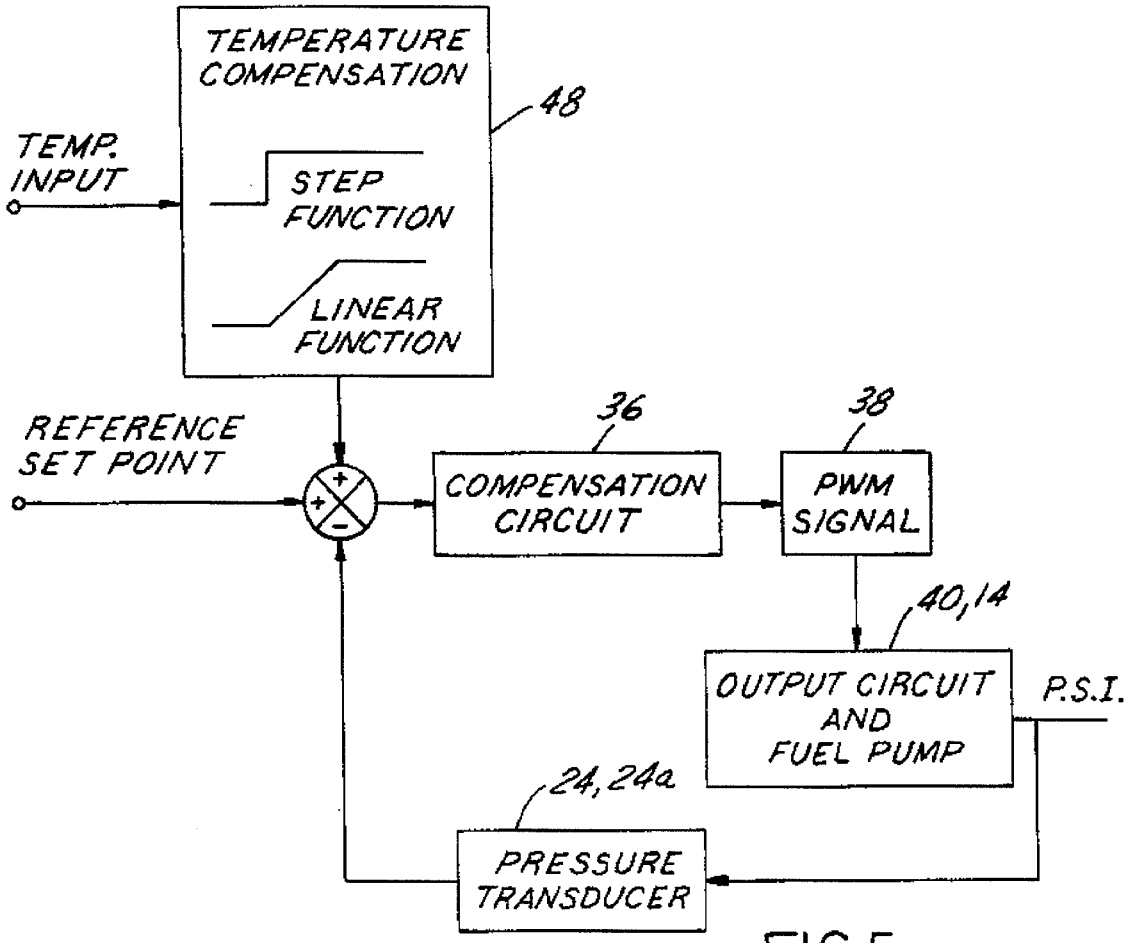
FIG. 5 is a functional block diagram that illustrates operation of the present invention.

FIG. 5 is a functional block diagram that illustrates operation of all embodiments of the invention in FIGS. 1–4. The temperature input is fed to temperature compensation function 48, which supplies either a stepped or linear compensation characteristic that is summed with the desired pressure reference set point. The difference between this sum and the output of the pressure sensor or transducer 24 or **24*a* is fed through compensation amplifier 36 to PWM amplifier 38, which drives output circuit 40 and pump/motor 14. The output pressure of the pump, either at the pump(FIG. 4) or at the fuel rail (FIGS. 2 and 3), is monitored by the pressure sensor 24 or 24*a*** to provide the pressure sensor signal.

The pressure reference input to amplifier 36 may be set at the time of system manufacture, or may be adjustable by the engine control computer or the operator. In the same way, the step-function or linear characteristics of temperature compensation circuit 48 may be set at the time of manufacture or variable in the field. Non-linear functions 52 and/or multiple thresholds and control gradients may be employed. In this respect, it will be appreciated that the specific pressure and temperatures discussed above are given by way of example only.

We claim:

1. A fuel delivery system for an internal combustion engine that comprises:

a fuel supply with a fuel pump responsive to application of electrical power for supplying fuel under pressure, fuel delivery means at the engine, a non-return fuel line between said pump and said fuel delivery means, and means for applying electrical power to said pump comprising:

a fuel pressure sensor for providing an electrical pressure signal as a function of fuel pump outlet pressure, circuit means responsive to said electrical pressure signal for applying electrical power to said pump, and a temperature sensor responsive to fuel temperature and operatively coupled to said circuit means for automatically varying power applied to said pump to maintain a preselected constant fuel pressure characteristic at the engine when temperature at said temperature sensor is below a preselected threshold temperature, and to increase pump output pressure as a preselected function of temperature at said temperature sensor when said temperature exceeds said preselected threshold temperature.

2. The system set forth in claim 1 wherein said preselected function is a step function.

3. The system set forth in claim 2 wherein said threshold temperature is about 200° F.

4. The system set forth in claim 1 wherein said increase in pump output pressure is about 15 to 20%.

5. The system set forth in claim 1 wherein said preselected function is a linear function.

6. The system set forth in claim 5 wherein said temperature threshold is about 100° F.

7. The system set forth in claim 6 wherein said temperature sensor is operatively coupled to said circuit means to increase pump output pressure linearly for a temperature of about 100° F. to a temperature of about 250° F.

8. The system set forth in claim 7 wherein said increase in pump output pressure between 100° F. to 250° F. is about 15 to 20%

9. The system set forth in claim 1 wherein said fuel delivery means includes an engine fuel rail coupled to said pump by said non-return fuel line, both said temperature sensor and said pressure sensor being disposed on said fuel rail so as to be responsive respectively to temperature and pressure of fuel at said rail.

10. The system set forth in claim 9 wherein the engine further includes an engine air intake manifold, and wherein said pressure sensor receives a reference input from said engine air intake manifold.

11. The system set forth in claim 1 wherein said pressure sensor is integral with said temperature sensor for directly modifying said electrical signal generated at said pressure sensor as a function of temperature above said threshold temperature.

12. The system set forth in claim 1 wherein said temperature sensor provides an electrical temperature signal as a function of temperature, and wherein said circuit means includes means responsive to said temperature signal for modifying said electrical pressure signal from said pressure sensor as a function of temperature above said threshold temperature.

* * * * *

UNITED STATES PATENT AND TRADEMARK OFFICE

CERTIFICATE OF CORRECTION

PATENT NO. : 5,542,395

DATED : August 6, 1996

INVENTOR(S) : Charles H. Tuckey and Kirk D. Doane

It is certified that error appears in the above-indentified patent and that said Letters Patent is hereby corrected as shown below:

Col. 5, Line 5, change "claim 1" to — claim 3 —.

Signed and Sealed this

Nineteenth Day of November, 1996

*Attest:*

*Attesting Officer*

BRUCE LEHMAN

*Commissioner of Patents and Trademarks*